US007702264B2

(12) United States Patent
Hirota et al.

(10) Patent No.: US 7,702,264 B2
(45) Date of Patent: Apr. 20, 2010

(54) IMAGE FORMING APPARATUS

(75) Inventors: Makoto Hirota, Ebina (JP); Takashi Yamamuro, Ebina (JP); Shigeru Inaba, Ebina (JP); Shota Oba, Ebina (JP); Akihiko Noda, Ebina (JP); Yoshifumi Ozaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 11/783,979

(22) Filed: Apr. 13, 2007

(65) Prior Publication Data

US 2008/0080905 A1 Apr. 3, 2008

(30) Foreign Application Priority Data

Sep. 28, 2006 (JP) ..... 2006-264320

(51) Int. Cl.
*G03G 15/08* (2006.01)

(52) U.S. Cl. ..... 399/265; 399/267; 399/270

(58) Field of Classification Search ..... 399/261, 399/265, 267, 270
See application file for complete search history.

(56) References Cited

U.S. PATENT DOCUMENTS 6,026,265 A * 2/2000 Kinoshita et al. ..... 399/281
7,457,570 B2 * 11/2008 Kasai et al. ..... 399/267
2001/0055503 A1 * 12/2001 Kin et al. ..... 399/284

FOREIGN PATENT DOCUMENTS

JP 2004-109873 4/2004

* cited by examiner

*Primary Examiner*—David M Gray
*Assistant Examiner*—Barnabas T Fekete
(74) *Attorney, Agent, or Firm*—Morgan Lewis & Bockius LLP

(57) ABSTRACT

An image forming apparatus includes an image carrier that carries a latent image; a charging device that charges the image carrier with a charging voltage having an AC component; and a roller that carries a developer to be supplied to the image carrier in a developing position, with a surface of the roller provided with axially-formed grooves, the frequency of the AC component of the charging voltage and the number of the grooves provided on the roller being set so that non-uniformity in density of an output image becomes invisible, caused by interference between the frequency of the AC component of the charging voltage and the frequency at which the grooves pass the developing position.

13 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2006-264320 filed Sep. 28, 2006.

BACKGROUND

1. Technical Field

The present invention relates to an image forming apparatus such as a copier, facsimile, or printer.

2. Related Art

Art related to this image forming apparatus, an approach that uses a roller with its surface provided with grooves to carry a developer is known.

SUMMARY

According to an aspect of the present invention, there is provided an image forming apparatus including an image carrier that carries a latent image; a charging device that charges the image carrier with a charging voltage having an AC component; and a roller that carries a developer to be supplied to the image carrier in a developing position, with a surface of the roller provided with axially-formed grooves, the frequency of the AC component of the charging voltage and the number of the grooves provided on the roller being set so that non-uniformity in density of an output image becomes invisible, caused by interference between the frequency of the AC component of the charging voltage and the frequency at which the grooves pass the developing position.

BRIEF DESCRIPTION OF THE DRAWINGS

An exemplary embodiment of the present invention will be described in detail based on the following figures, wherein.

DETAILED DESCRIPTION

Then, an exemplary embodiment of the present invention will be described based on the drawings.

Figure 1:
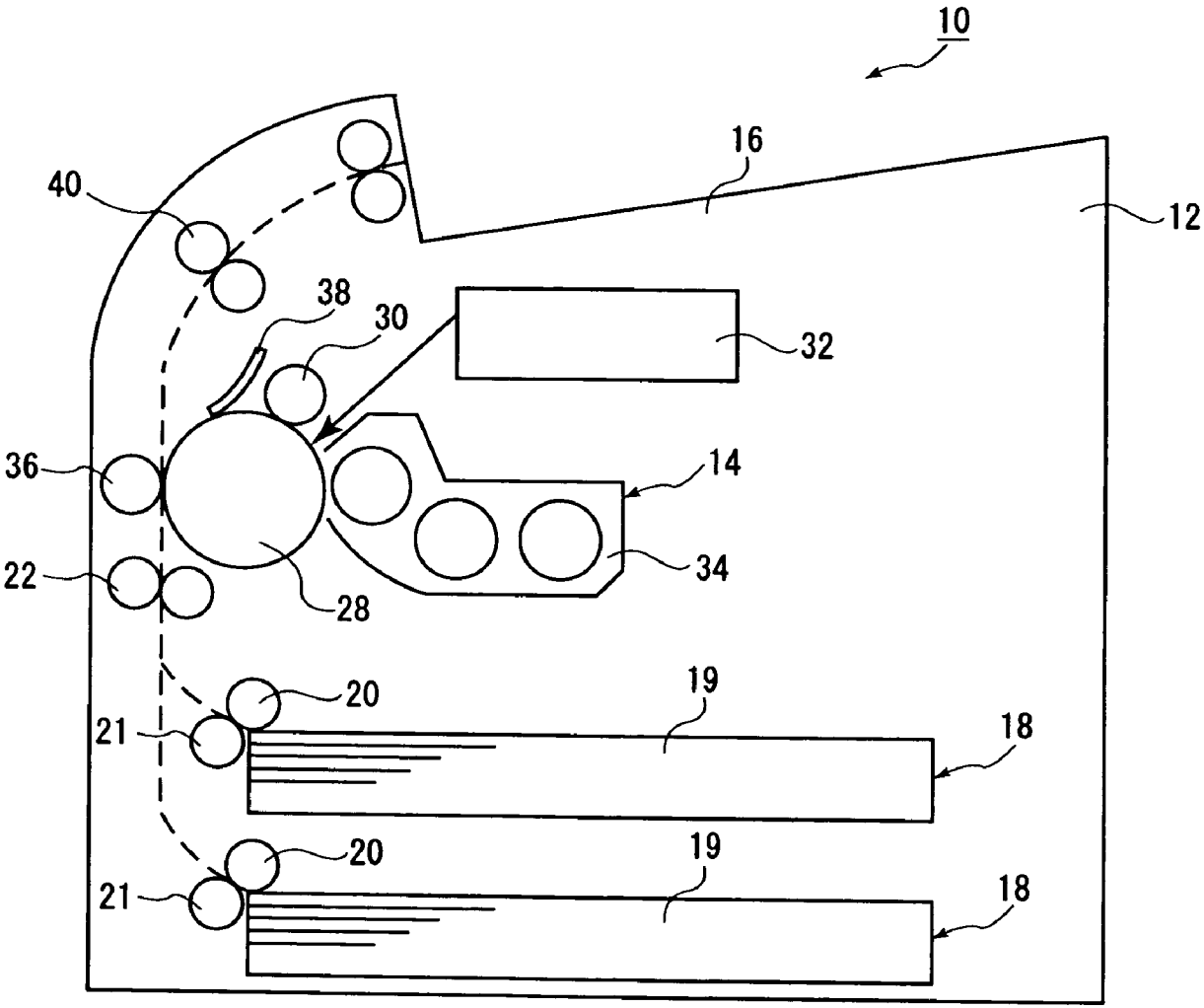
FIG. 1 is a side view showing an outline of an image forming apparatus relevant to an exemplary embodiment of the invention.

FIG. 1 shows an outline of an image forming apparatus 10 relevant to an exemplary embodiment of the invention. The image forming apparatus 10 has an image forming apparatus main body 12 and an output part 16 for outputting sheets is provided in the top end of the image forming apparatus main body 12. Inside the image forming apparatus main body 12, an image forming unit 14 and sheet feeders 18 which are disposed, for example, in two stages are installed.

The image forming unit 14 which forms an electrophotographic image is composed of a drum-shaped photoreceptor 28 which is used as a latent image carrier, a charging device 30 which charges the photoreceptor 28 uniformly, an optical device 32 which emits light for illuminating the photoreceptor 28 charged by the charging device 30, thus creating a latent image on the photoreceptor 28, a developing device 34 which applies a developer to a latent image formed on the surface of the photoreceptor 28 by the optical device 32, thus making the latent image visible, a transfer device 36 having, for example, a transfer roller which transfers a developer image formed by the developing device 34 onto a sheet, a cleaning device 38 equipped with, for example, a cleaning blade or the like to clear remaining developer particles from the photoreceptor 28, and a fixing device 40 which fuses a developer image transferred onto a sheet by the transfer device 36 and fixes the developer image to the sheet. The optical device 32 is, for example, a scanning-type laser exposure device and creates a latent image on the photoreceptor 28. The optical device 32 can employ an LED, a surface emitting laser or the like as an alternative exemplary embodiment.

Some or all of the members constituting the image forming unit 14 may be integrated into a cartridge. For example, the photoreceptor 28, the charging device 30, the developing device 34, and the cleaning device 38 may be integrated into a process cartridge so that these components can be installed in and removed from the image forming apparatus main body 12 together as an assembly.

The sheet feeders 18 respectively include sheet containers 19, each having, for example, a paper cassette, pickup rollers 20 which pick up a sheet at the top of a sheet stack contained in the sheet containers 19, and feed rollers 21 which move the sheets picked up by pickup rollers 20 forward. The sheet feeders 18 feed each sheet out of the stacks of sheets contained in the sheet containers 19 to the above image forming unit 14.

Registration rollers 22 are disposed downstream of the feed rollers 21 in a sheet transport direction, the above transfer device 36 and photoreceptor 28 are disposed downstream of the registration rollers 22, and the above fixing device 40 is disposed further downstream.

Figure 2:
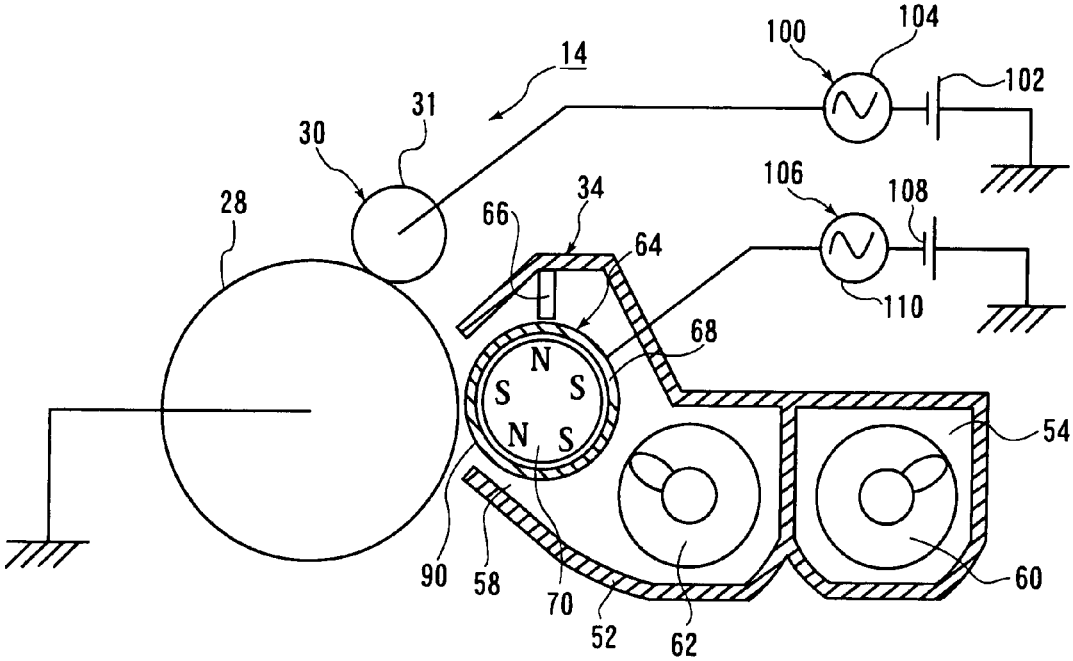
FIG. 2 is a cross-sectional lateral view of a developing device used in the image forming apparatus relevant to the exemplary embodiment of the invention.

In FIG. 2, the photoreceptor 28, the developing device 34, and the charging device 30 are depicted. The developing device 34 uses a two-component developer including non-magnetic toner and magnetic carrier particles and, as the magnetic carrier particles, those having a shape factor of about 120 or less are used. Here, the shape factor is referred to as SF1. An enlarged photograph image of magnetic carrier particles obtained by an optical microscope (e.g., Micro Photo FXA supplied by Nikon Corporation) is analyzed by an image analyzer (e.g., Luzex III supplied by NIRECO Corporation) and the shape factor of these particles is calculated by use of an equation (1) specified below. The shape factor is represented as a ratio of the projected area (profile) of a magnetic carrier particle to the area of a circle circumscribing the particle profile. If the particle is a true spherical form, then its shape factor is 100, and the shape factor increases as the spherical form of the particle is deformed.

$$SF1=(\text{maximum absolute length of toner particle diameter})^2/(\text{projected area of toner particle})\times(\pi/4)\times 100 \quad (1)$$

As the magnetic carrier particles, polymerized carrier particles are used. Here, the polymerized carrier particles refer to those manufactured by a polymerization method such as an emulsion polymerization method or a suspension polymerization method. By manufacturing carrier particles by the polymerization method, carrier particles that are more approximate to the spherical form, that is, the particles with SF1 nearer to 100 can be produced. Alternatively to the use of the polymerized carrier particles as the magnetic carrier, resin-filled carrier particles may be used. Here, the resin-filled carrier particles refer to those manufactured by solidifying fine ferrite powders into a spherical core and filling the core with a resin. Similar to the polymerized carrier particles, this manufacturing manner can produce carrier particles that are more approximate to the spherical form.

The developing device 34 has a developing device main body 52. The developing device main body 52 is partitioned into a storage chamber 54 which is used as a container for the two-component developer and a developing chamber 58 with an opening 56 for development defined to face the photoreceptor 28.

An auger 60 is provided in the storage chamber 54 and an auger 62 and a developing roller 64 are provided in the developing chamber 58. The augers 60, 62 are used to stir the developer and move the developer to the developing roller 64. In the developing chamber 58, a trimming member 66 which is used for limiting the thickness of a developer layer is also provided. The trimming member 66 limits the layer of the two-component developer formed on and carried by the surface of the developing roller 64 to a given thickness.

The developing roller 64 has a developing sleeve 68 which is used as a developer carrier and a magnet roller 70 which is positioned on the inner surface of the developing sleeve 68, fit and secured to the developing device main body 52. In the magnet roller 70, multiple S poles and N poles of permanent magnets are arranged appropriately. By a magnetic force generated from the magnetic roller 70, magnetic brushes are formed on the surface of the developing sleeve 68.

To the developing roller 64, a power supply 106 which is used as a developing voltage application device that applies a developing voltage is connected. The power supply 106 has a DC power supply 108 and an AC power supply 110 and the developing voltage in which an AC component is superimposed on a DC component is applied from the power supply 106 to the developing roller 64. The frequency f3 of the AC power supply 110 is on the order of 2000 Hz.

The charging device 30 includes a contact-type charging roller 31 that contacts with the photoreceptor 28 and a power supply 100 which is used as a charging voltage application device that applies a charging voltage is connected to the charging roller 31. The power supply 100 has a DC power supply 102 and an AC power supply 104 and the charging voltage in which an AC component is superimposed on a DC component is applied from the power supply 100 to the charging roller 31. The frequency f1 of the AC power supply 104 is on the order of 900 Hz.

Figure 3:
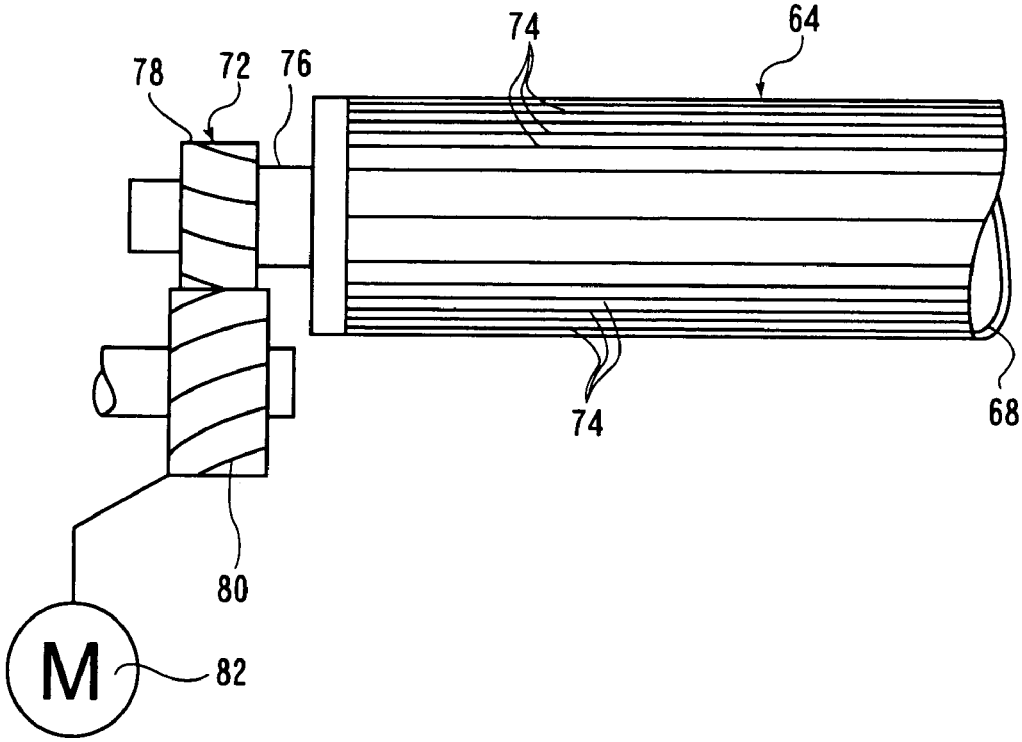
FIG. 3 is an illustration to explain a developing sleeve and a mechanism of driving the developing sleeve used in the image forming apparatus relevant to the exemplary embodiment of the invention.

In FIG. 3, the developing sleeve 68 and a driving mechanism 72 that turns and drives the developing sleeve 68 are shown. The developing sleeve 68 has a cylindrical shape and is made of, for example, aluminum or the like. The outside diameter of the developing sleeve 68 is 20 mm and grooves 74 are provided, substantially evenly spaced apart, on the surface of the sleeve in a longitudinal direction (along a shaft 76 which will be mentioned later). One hundred grooves 74 are provided, substantially evenly spaced apart, over the entire surface of the developing sleeve 68.

The driving mechanism 72 includes a gear 78 connected to the developing sleeve 68 via the shaft 76, a gear 80 which is engaged with the gear 78, and a driving power source 82 having, for example, a motor or the like which is connected to the gear 80 and delivers the driving force to the gear 80. The rotary driving force from the driving power source 82 is conveyed to the developing sleeve 68 via the gear 80, the gear 78, and the shaft 76, so that the developing sleeve 68 rotates. The developing sleeve 68 rotates at a circumferential speed of 200 mm/s. The circumferential speed of the developing sleeve 68 is 200 mm/s, whereas the circumferential speed of the photoreceptor is 100 mm/s.

As the gear 78, a gear having approximately 20 teeth is employed. As the gear 78 and the gear 80, it is desirable to use helical gears.

Figure 4:
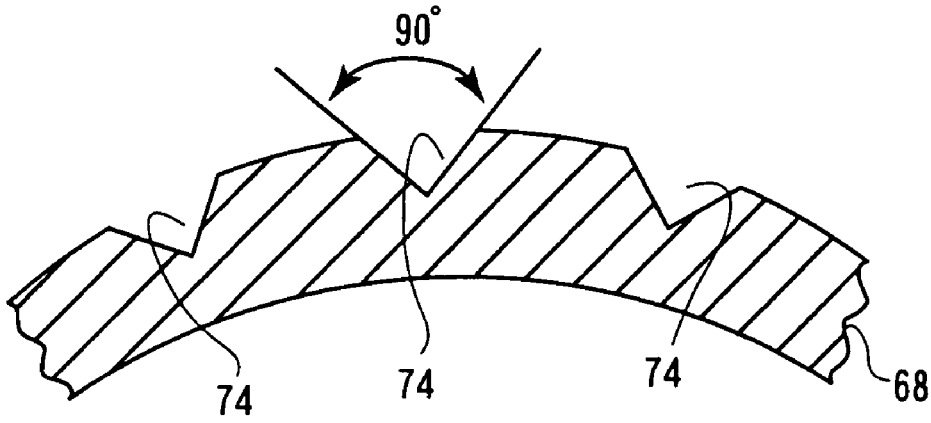
FIG. 4 is a cross-sectional diagram showing a surface appearance of the developing sleeve used in the image forming apparatus relevant to the exemplary embodiment of the invention.

In FIG. 4, an appearance of the surface of the developing sleeve 68 is shown. The grooves 74 are V shaped with a groove angle of about 90 degrees and the depth of a groove 74 is about 100 μm. The non-grooved surface of the developing sleeve 68 has an arithmetic average of roughness Ra that is on the order of 0.3 or less. This value is based on the surface roughness measured as per JIS B0601-1994.

In the image forming apparatus 10 configured as described above, the charging device 30 charges the surface of the photoreceptor 28 uniformly and the optical device 32 projects an image on the uniformly charged surface of the photoreceptor 28, thereby forming a latent image on the surface of the photoreceptor 28. This latent image is developed by the developing device 34 and, then, a developer image is formed on the surface of the photoreceptor 28. The transfer device 36 transfers this developer image onto a sheet supplied from ether of the sheet feeders 18, the developer image is fixed on the sheet by the fixing device 40, and the sheet having the developer image fixed thereon is output to the output part 16.

In the developing device 34, the two-component developer particles are stirred by the augers 60, 62 and moved to the developing roller 64, while charged by friction. When the developer particles moved to the developing roller 64 pass by the developing roller 64, some of the particles are attracted to the surface of the developing sleeve 68 by the magnetic force of the magnet roller 70. The amount of the developer particles attracted to the surface of the developing sleeve 68 during a developing operation is about 400 g/m2. The developer particles attracted to the developing sleeve 68 move to the surface of the photoreceptor 28 and develop an electrostatic latent image formed on the surface of the photoreceptor 28.

On the developing sleeve 68, more magnetic brushes tend to exist in the grooves 74. Consequently, when the magnetic brushes pass a developing position 90 located between the developing roller 64 and the photoreceptor 28, there occurs a difference between the amount of developer particles moved to the photoreceptor 28 from the grooves 74 and that amount moved from the surface without the grooves 74. Due to this, in an image eventually formed on a sheet, density non-uniformity may appear at a pitch corresponding to the pitch of the grooves 74. However, in this image forming apparatus 10, the developing sleeve 68 is provided with a sufficient number of grooves 74 as much as the order of one hundred, as indicated above. This provision of the grooves at a sufficiently small pitch on the developing sleeve 68 is intended to suppress the occurrence of density non-uniformity to a small degree in which the non-uniformity is not distinguishable to human eyes.

Not only by the effect of the grooves 74, density non-uniformity may occur in an output image due to an effect of the charging device 30. As already mentioned, the charging voltage having an AC component is applied to the charging roller 31. As a result, the photoreceptor 28, after charged by the charging device 30, may be put in a state where a distribution of surface potentials that vary periodically in relation to the frequency of the AC component of the charging bias, appearing like stripes, is developed in a circumferential direction. Under the effect of this distribution of surface potentials, there may appear density non-uniformity corresponding to the frequency of the AC component of the bias in an image eventually formed on a sheet. However, in this image forming apparatus 10, the frequency of the AC power supply 104 is set at a sufficiently large value to reduce the pitch of density non-uniformity occurring in an output image on a sheet. This narrows the density non-uniformity to a small degree in which the non-uniformity is not distinguishable to human eyes.

The image forming apparatus 10 improves the quality of a formed image by suppressing the density non-uniformity caused by the effect of the grooves 74 provided on the developing sleeve 68 and the density non-uniformity caused by the effect of the AC component of the charging voltage to such a narrow pitch that makes the non-uniformity distinguishable to human eyes, as described above. However, image quality deterioration in which zonal shading occurs in an output image might occur by the effect of a beat caused by interference between the frequency f1 of the AC power supply 104 and the frequency f2 of movement of the grooves 74, defined as the number of the grooves 74 pass the developing position 90 per unit time (one second). In this image forming apparatus 10, the possibility of such image quality deterioration is reduced by elaborating how to set the frequency f1 of the AC component of the charging voltage and the number of the grooves 74, one of values to determine the frequency f2 of movement of the grooves 74.

The frequency f1 can be set to a desired value under the control by a control circuit which is not shown in the drawings. On the other hand, the frequency f2 is calculated by $N \cdot V2/\pi \cdot D$, where N is the number of grooves provided on the developing sleeve 68, V2 (mm/s) is the circumferential speed of the developing sleeve, and D (mm) is the outside diameter of the developing sleeve 68. Therefore, for example, if the circumferential speed V2 and the outside diameter D are fixed according to image process requirements and for apparatus layout convenience, the frequency f2 is set by increasing or decreasing the number N of the grooves 74 provided on the developing sleeve 68.

The pitch P1 of density non-uniformity occurring on the surface of the photoreceptor 28 and a sheet, caused by the beat between the frequency f1 and the frequency f2, is calculated by the following equation (1):

$$P1\ (\text{mm}) = V1/|f1-f2| \quad (1)$$

where V1 (mm/s) is the circumferential speed of the photoreceptor.

In the image forming apparatus 10, the frequency f1 and the number N of the grooves 74 are set so that the density non-uniformity pitch P1 becomes hard to distinguish by human eyes, that is, it becomes invisible. The frequency f1 is 900 Hz, as already mentioned. As already mentioned, the number N of grooves 74 is on the order of one hundred, the circumferential speed V2 of the developing sleeve 68 is 200 mm/s, and the outside diameter D of the developing sleeve 68 is approximately 20 mm. Hence, f2 that is calculated by $N \cdot V2/\pi \cdot D$ is approximately 318.3 Hz. Since the circumferential speed V1 of the photoreceptor 28 is 100 mm/s, the density non-uniformity pitch P1 will be approximately 0.17 mm, as obtained from equation (1). In the image forming apparatus 10, the frequency f1 of the AC component of the charging voltage and the number N of the grooves provided on the developing sleeve 68 are set to fulfill the following conditional expression (2) in which the density non-uniformity pitch P1 is limited to 0.5 mm or less and to fulfill the following conditional expression (3) in which the pitch P1 is limited to 0.3 mm or less.

$$V1/|f1-f2| \leqq 0.5\ (\text{mm}) \quad (2)$$

$$V1/|f1-f2| \leqq 0.3\ (\text{mm}) \quad (3)$$

A threshold value of the density non-uniformity pitch P1 that makes the non-uniformity hard to distinguish by human eyes and invisible is indeterminable, depending on the type and size of an image formed, how to use the image, and so on. However, in general, when the pitch is over 0.5 mm, the non-uniformity becomes easy to distinguish by human eyes; when the pitch is 0.5 mm or less, the non-uniformity often becomes hard to distinguish. Therefore, in this image forming apparatus 10, the frequency f1 and the number N of the grooves are set so that the pitch P1 becomes 0.5 mm or less, as indicated above.

In this exemplary embodiment, the pitch P1 is approximately 0.17 mm. However, for a particular type and size of an image formed, a particular use of the image, and so on, the frequency f1 and the number N of the grooves 74 may be set so that the pitch P1 becomes 0.1 mm or less, that is, to fulfill a relation described by the following conditional expression (4) and make the density non-uniformity pitch in an output image more unnoticeable.

$$V1/|f1-f2| \leqq 0.1\ (\text{mm}) \quad (4)$$

Similar to the image quality deterioration produced by the effect of the beat caused by interference between the frequency f1 of the AC power supply 104 that applies the charging voltage and the frequency f2 of movement of the grooves 74, image quality deterioration in which zonal shading occurs in an output image might occur by the effect of a beat caused by interference between the frequency f3 of the AC power supply 110 that applies the developing voltage and the frequency f2. In this image forming apparatus 10, the possibility of such image quality deterioration is reduced by elaborating how to set the frequency f3 of the AC component of the developing voltage and the number N of the grooves 74, one of values to determine the frequency f2.

The pitch P2 of density non-uniformity occurring on the surface of the photoreceptor 28 and a sheet, caused by the beat between the frequency f3 and the frequency f2, is calculated by the following equation (5):

$$P2\ (\text{mm}) = V1/|f3-f2| \quad (5)$$

where V1 (mm/s) is the circumferential speed of the photoreceptor.

In the image forming apparatus 10, the frequency f1 and the number N of the grooves 74 are set as described above and, further, the frequency f3 is set so that the density non-uniformity pitch P2 becomes hard to distinguish by human eyes and invisible. That is, as already mentioned, the frequency f3 is on the order of 2000 Hz, f2 is approximately 318 Hz, and the circumferential speed of the photoreceptor 28 is approximately 100 mm/s. Hence, the density non-uniformity pitch P2 will be approximately 0.06 mm, as obtained from equation (5). In the image forming apparatus 10, specifically, the frequency f3 of the AC component of the developing voltage and the number N of the grooves provided on the developing sleeve 68 are set to fulfill the following conditional expression (6) in which the density non-uniformity pitch P2 is limited to 0.5 mm or less, fulfill the following conditional expression (7) in which the pitch P2 is limited to 0.3 mm or less, and fulfill the following conditional expression (8) in which the pitch P2 is limited to 0.1 mm or less.

$$V1/|f3-f2| \leqq 0.5 \text{ (mm)} \quad (6)$$

$$V1/|f3-f2| \leqq 0.3 \text{ (mm)} \quad (7)$$

$$V1/|f3-f2| \leqq 0.1 \text{ (mm)} \quad (8)$$

A threshold value of the density non-uniformity pitch P2 that makes the non-uniformity indistinguishable by human eyes is indeterminable, depending on the type and size of an image formed, how to use the image, and so on, as is the case for the pitch P1. However, when the pitch is over 0.5 mm, the non-uniformity becomes easy to distinguish by human eyes; when the pitch is 0.5 mm or less, the non-uniformity often becomes hard to distinguish. Therefore, in this image forming apparatus 10, the frequency f3 and the number N of the grooves are set so that the pitch P2 becomes 0.5 mm or less, as indicated above.

Further, in the image forming apparatus 10, the frequency f3 and the number N of the grooves are set so that the pitch P2 becomes 0.3 mm or less and, optionally, the pitch P2 becomes 0.1 mm or less, as indicated above.

As described above, the present invention can be applied to an image forming apparatus such as, for example, a copier, facsimile, or printer including the developing device equipped with the developing roller that carries the developer.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus, comprising:

an image carrier that carries a latent image;

a charging device that charges the image carrier with a charging voltage having an AC component; and a roller that carries a developer to be supplied to the image carrier in a developing position, with a surface of the roller having axially-formed grooves therein, the frequency of the AC component of the charging voltage and the number of the grooves provided on the roller being set so that non-uniformity in density of an output image becomes invisible, the non-uniformity being caused by interference between the frequency of the AC component of the charging voltage and the frequency at which the grooves pass the developing position.

2. The image forming apparatus according to claim 1, wherein a developer comprising toner particles and carrier particles having a shape factor of about 120 or less is used.

3. The image forming apparatus according to claim 1, wherein the carrier comprises polymerized carrier particles or resin-coated carrier particles.

4. The image forming apparatus according to claim 1 wherein the charging device being directly connected to the image carrier.

5. An image forming apparatus, comprising:

an image carrier that carries a latent image;

a charging device that charges the image carrier with a charging voltage having an AC component; and a roller that carries a developer to be supplied to the image carrier in a developing position, with a surface of the roller having axially-formed grooves therein, the frequency of the AC component of the charging voltage and the number of the grooves passing the developing position per second being set to fulfill the following relation:

$$V1/|f1-f2| \leqq 0.5 \text{ (mm)}$$

where f1 is the frequency of the AC component of the charging voltage;

f2 is the number of the grooves passing the developing position per second; and V1 (mm/s) is the circumferential speed of the image carrier.

6. The image forming apparatus according to claim 5 wherein the charging device being directly connected to the image carrier.

7. An image forming apparatus, comprising:

an image carrier that carries a latent image;

a charging device that charges the image carrier with a charging voltage having an AC component; and a roller that carries a developer to be supplied to the image carrier in a developing position, with a surface of the roller having axially-formed grooves therein, the developer comprising toner particles and polymerized carrier particles or resin-coated carrier particles having a shape factor of about 120 or less, and the frequency of the AC component of the charging voltage and the number of the grooves passing the developing position per second being set to fulfill the following relation:

$$V1/|f1-f2| \leqq 0.5 \text{ (mm)}$$

where f1 is the frequency of the AC component of the charging voltage;

f2 is the number of the grooves passing the developing position per second; and Vi (mm/s) is the circumferential speed of the image carrier.

8. The image forming apparatus according to claim 7 wherein the charging device being directly connected to the image carrier.

9. An image forming apparatus, comprising:

an image carrier that carries a latent image; and a roller to which a developing voltage having an AC component is applied and which carries a developer to be supplied to the image carrier in a developing position, with a surface of the roller having axially-formed groves therein, the frequency of the AC component of the developing voltage and the number of the grooves provided on the roller being set so that non-uniformity in density of an output image becomes invisible, the non-uniformity being caused by interference between the frequency of the AC component of the developing voltage and the frequency at which the grooves pass the developing position.

10. The image forming apparatus according to claim 9, wherein a developer comprising toner particles and carrier particles having a shape factor of about 120 or less is used.

11. The image forming apparatus according to claim 10, wherein the carrier comprises polymerized carrier particles or resin-coated carrier particles.

12. An image forming apparatus, comprising:

an image carrier that carries a latent image; and a roller to which a developing voltage having an AC component is applied and which carries a developer to be supplied to the image carrier in a developing position, with a surface of the roller having axially-formed groves therein, the frequency of the AC component of the developing voltage and the number of the grooves passing the developing position per second being set to fulfill the following relation:

$$V1/|f3-f2| \leqq 0.5 \text{ (mm)}$$

where f3 is the frequency of the AC component of the developing voltage;

f2 is the number of the grooves passing the developing position per second; and V1 (mm/s) is the circumferential speed of the image carrier.

13. An image forming apparatus, comprising:

an image carrier that carries a latent image; and a roller to which a developing voltage having an AC component is applied and which carries a developer to be supplied to the image carrier in a developing position, with a surface of the roller having axially-formed groves therein, the developer comprising toner particles and polymerized carrier particles or resin-coated carrier particles with a shape factor of about 120 or less, and the frequency of the AC component of the developing voltage and the number of the grooves passing the developing position per second being set to fulfill the following relation:

$$V1/|f3-f2| \leqq 0.5 \text{ (mm)}$$

where f3 is the frequency of the AC component of the developing voltage;

f2 is the number of the grooves passing the developing position per second; and V1 (mm/s) is the circumferential speed of the image carrier.

* * * * *